US011986704B2

(12) United States Patent
Cales

(10) Patent No.: US 11,986,704 B2
(45) Date of Patent: May 21, 2024

(54) SPORTS BALL EASY LOADING AND UNLOADING APPARATUS

(71) Applicant: David Cales, Washington, IL (US)

(72) Inventor: David Cales, Washington, IL (US)

( * ) Notice: Subject to any disclaimer, the term of this patent is extended or adjusted under 35 U.S.C. 154(b) by 0 days.

(21) Appl. No.: 17/712,507

(22) Filed: Apr. 4, 2022

(65) Prior Publication Data

US 2022/0323831 A1 Oct. 13, 2022

Related U.S. Application Data

(60) Provisional application No. 63/227,456, filed on Jul. 30, 2021, provisional application No. 63/173,654, filed on Apr. 12, 2021.

(51) Int. Cl.
*A63B 47/00* (2006.01)

(52) U.S. Cl.
CPC ..... *A63B 47/00* (2013.01)

(58) Field of Classification Search
CPC ..... A63B 47/00; A63B 47/002; A63B 47/007; A63B 2102/18; A63B 2069/401; A63B 69/0002; A63B 69/0075; A63B 69/407; B65D 25/32; B65D 21/0209; B65D 21/02; B65D 21/0233; B65D 21/0212; B65D 21/0224
USPC ..... 220/636; 206/315.9, 315.1, 579, 499; 211/15, 14, 184, 59.2, 49.1; 294/19.2
See application file for complete search history.

(56) References Cited

U.S. PATENT DOCUMENTS 1,982,273 A * 11/1934 Vogel ..... G07F 11/44 221/281
2,296,215 A * 9/1942 Layher ..... A47F 1/06 220/536
3,206,197 A * 9/1965 Miotke ..... A63B 57/0037 473/131
3,494,503 A * 2/1970 Eleanor ..... B65G 1/07 312/306
4,221,524 A * 9/1980 Morris ..... A63B 47/021 414/439
5,433,491 A * 7/1995 Green ..... A63B 47/02 206/315.9

(Continued)

*Primary Examiner* — Steven A. Reynolds
*Assistant Examiner* — Prince Pal
(74) *Attorney, Agent, or Firm* — The Law Offices of Konrad Sherinian, LLC

(57) ABSTRACT

A sports ball easy loading and unloading apparatus assists a user loading, unloading, and sorting balls in a container by selectively elevating the container holding the balls, which minimizes stooping repeatedly to access the sports balls. The apparatus provides a first container configured to contain sports balls. The first container is disposed inside a second container having a larger diameter. The first container can elevate and lower in relation to second container. A spring-loaded elevator is disposed inside the second container, and beneath the floor wall of first container. The spring-loaded elevator comprises a spring that biases to expand, and turntables configured to lock the spring at desired positions. In this manner, the spring-loaded elevator enables selective elevation, lowering, and positional locking of the first container for easy loading/unloading of balls. A user can also sit on a lid atop the first container when fully compressed inside second container.

7 Claims, 10 Drawing Sheets

(56) References Cited

U.S. PATENT DOCUMENTS

| | | | | |
|---|---|---|---|---|
| 6,213,574 | B1 * | 4/2001 | Pierce | A63B 47/002 206/315.9 |
| 7,166,034 | B2 * | 1/2007 | Hines | A63B 57/16 473/137 |
| 10,947,010 | B2 * | 3/2021 | Castelli | B65D 25/32 |
| 2004/0232016 | A1 * | 11/2004 | Dietrich | A63B 55/404 206/315.6 |
| 2006/0196488 | A1 * | 9/2006 | Morshed | A63B 47/002 124/49 |
| 2009/0179443 | A1 * | 7/2009 | Turdo | A63B 47/02 294/19.2 |
| 2009/0224560 | A1 * | 9/2009 | Turdo | A63B 47/02 294/19.2 |
| 2009/0266738 | A1 * | 10/2009 | Dunford | B65D 25/32 220/761 |
| 2015/0102044 | A1 * | 4/2015 | Leibel | B65D 25/20 220/636 |
| 2016/0114237 | A1 * | 4/2016 | Garcia, Jr. | B65D 25/10 206/315.1 |
| 2017/0361176 | A1 * | 12/2017 | Sherr | B65G 1/07 |
| 2018/0015649 | A1 * | 1/2018 | Hutchinson | B29C 33/02 |
| 2020/0023258 | A1 * | 1/2020 | Wherley | A63B 63/00 |
| 2020/0070013 | A1 * | 3/2020 | Kohn | A63B 47/02 |
| 2022/0118317 | A1 * | 4/2022 | Chang | A63B 47/00 |

* cited by examiner

SPORTS BALL EASY LOADING AND UNLOADING APPARATUS

CROSS-REFERENCE

The present application claims priority of U.S. Provisional Pat. App. No. 63/227,456, filed on Jul. 30, 2021 on behalf of inventor David Cales, which is incorporated by reference in the entirety. This application also claims priority to U.S. Provisional Pat. App. No. 63/173,654, which was filed on Apr. 12, 2021 on behalf of inventor David Cales, which is incorporated by reference in the entirety.

FIELD OF THE DISCLOSURE

The present disclosure relates to a sports ball easy loading and unloading apparatus, and more particularly, to a loading and unloading apparatus that provides a container configured to contain one or more balls, and a spring-loaded elevator that enables selective elevation of the container for easy unloading of the balls, and lowering of the container for stowage and sitting when a lid is set on the container.

SUMMARY OF THE DISCLOSURE

According to an aspect of the disclosure a sports ball easy loading and unloading apparatus is disclosed. In one aspect, the sports ball easy loading and unloading apparatus comprises a first container with a particular diameter. In certain embodiments the first container can be a five gallon bucket, a six gallon bucket, or an alternative size of bucket. The first container has a floor wall and a sidewall that terminates at a rim that defines an opening and allows access to the interior of the bucket, which is sized to hold a number of balls, such as baseballs, softballs, tennis balls, golf balls, or other sports balls. It should be noted that while the disclosed loading and unloading apparatus is generally disclosed as working with sports balls, it can work with other small objects as well.

The disclosed sports ball easy loading and unloading apparatus also includes a second container that can also be a five gallon bucket, a six gallon bucket, or an alternative size of bucket. The second container has a second diameter, which can be larger than the first diameter, so that the second container can contain the first container. The second container also includes a floor wall and a side wall, and is configured to contain the first container so that the floor warlls are in a parallel, spaced-apart relationship.

In certain embodiments, the first container can include a stop flange disposed beneath the rim of the first container, the stop flange generally encircling the entirety of the first container, and being sized so as to prevent the first container from dropping further into the second container.

In a further embodiment, a rotatable handle can be disposed in the stop flange at two opposing points along the exterior surface of the slop flange. The handle can have a grip that allows a user to easly grasp and lift the sports ball easy loading and unloading apparatus.

In a further embodiment, the sports ball easy loading and unloading apparatus can further comprise an elevator disposed within the second container so as to support the floor wall of the first container. In a particular embodiment the elevator can comprise a plurality of rotatable turntables with each of the pluralty of rotatable turntables being disposed vertically, one on top of the other, with a bottom rotatable turntable being mounted to an upper surface of the floor wall of the second container and with a top rotatable turntable being mounted to a lower surface of the floor wall of the first container. In certain embodiments the elevator can comprise a biasing device, such as helical spring, as well as a locking mechanism to lock the spring at a certain level of bias.

OBJECTS OF THE DISCLOSURE

One objective of the present disclosure is to help prevent a user from stooping over repeatedly while accessing sports balls from a container.

Another objective is to provide an easy to operate spring-loaded elevator that allows the user to elevate the first container, so as to load and/or unload the balls therein.

Yet another objective is to provide a seat on the lid of the first container when the spring is fully compacted, such that the first container is contained inside the second container.

Yet another objective is to make the sports ball easy loading and unloading apparatus lightweight for enhanced portability.

Yet another objective is to make an inexpensive to manufacture sports ball easy loading and unloading apparatus.

Other advantages of this disclosure will be clear to a person of ordinary skill in the art. It should be understood, however, that a system, an apparatus or a method could practice the disclosure while not achieving all of the enumerated advantages, and that the claims define the protected disclosure.

BRIEF DESCRIPTION OF THE DRAWINGS

Although the characteristic features of this disclosure will be particularly pointed out in the claims, the disclosed method and system, and how it may be made and used, may be better understood by referring to the following description taken in connection with the accompanying drawings forming a part hereof, wherein like reference numerals refer to like parts throughout the several views and in which:

A person of ordinary skill in the art will appreciate that elements of the figures above are illustrated for simplicity and clarity and are not necessarily drawn to scale. The dimensions of some elements in the figures may have been exaggerated relative to other elements to help to understand the present teachings. Furthermore, a particular order in which certain elements, parts, components, modules, steps, actions, events and/or processes are described or illustrated may not be required. A person of ordinary skills in the art will appreciate that, for simplicity and clarity of illustration, some commonly known and well-understood elements that are useful and/or necessary in a commercially feasible embodiment may not be depicted to provide a clear view of various embodiments per the present teachings.

DETAILED DESCRIPTION

In the following description of various examples of embodiments of the disclosed apparatus and method, reference is made to the accompanying drawings, which form a part hereof, and in which are shown by way of illustration various example devices, systems, and environments in which aspects of the disclosed apparatus and method can be practiced. Other specific arrangements of parts, example devices, systems, and environments, can be used, and structural modifications and functional modifications can be made without departing from the scope of the disclosed apparatus and method.

Figure 1A:
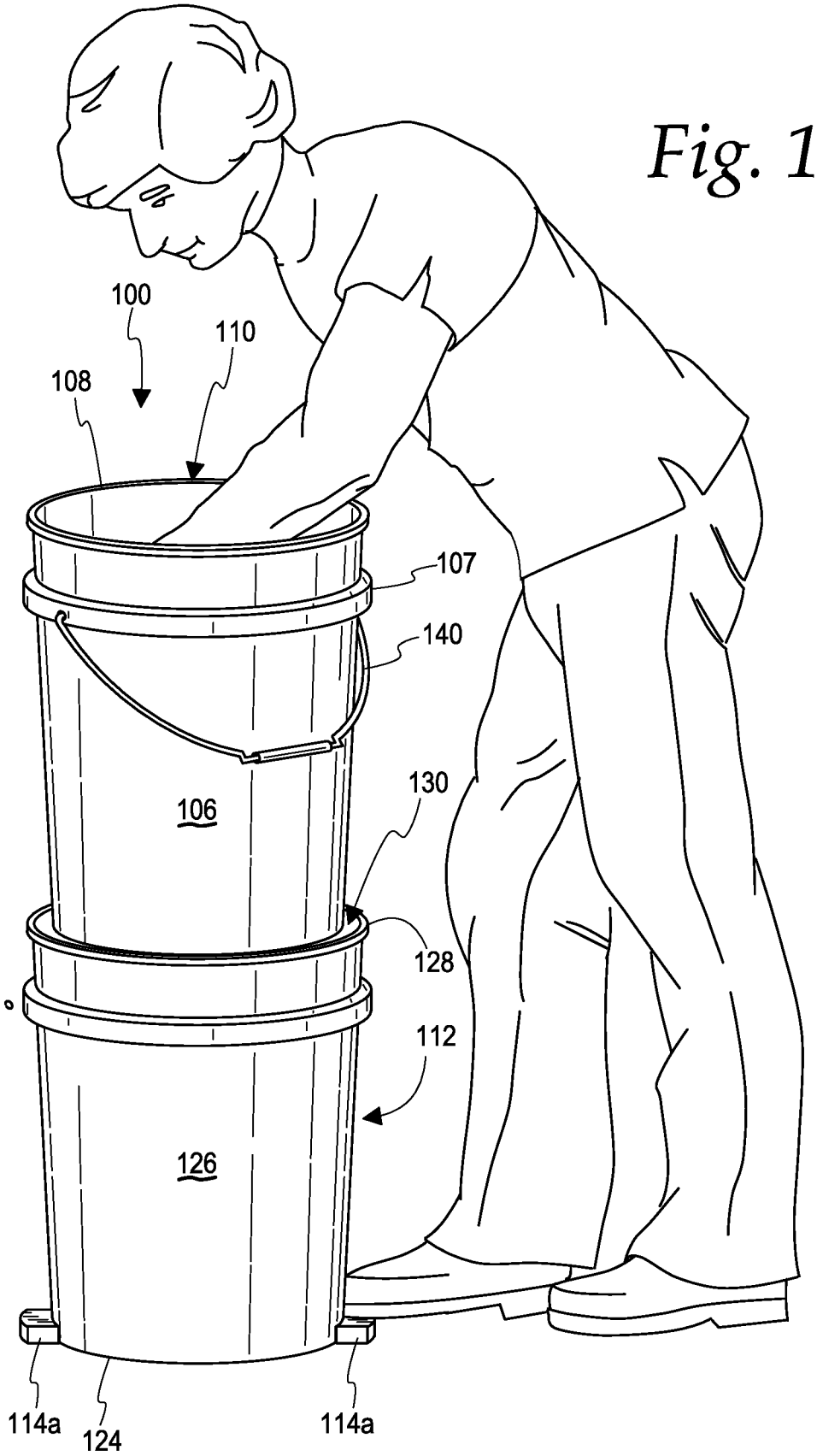
FIG. 1A is a perspective view of an exemplary sports ball easy loading and unloading apparatus, showing a user unloading balls from an elevated first container, in accordance with an embodiment of the disclosure.

Turning to the Figures and FIG. 1A in particular, a sports ball easy loading and unloading apparatus 100, hereafter "apparatus 100" assists a user to load, unload, carry, and sort one or more balls 500*a*, 500$_n$ in a container by allowing the user to selectively elevate the container holding the balls. This minimizes stooping repeatedly by the user to access the balls 500*a-n*.

Figure 1B:
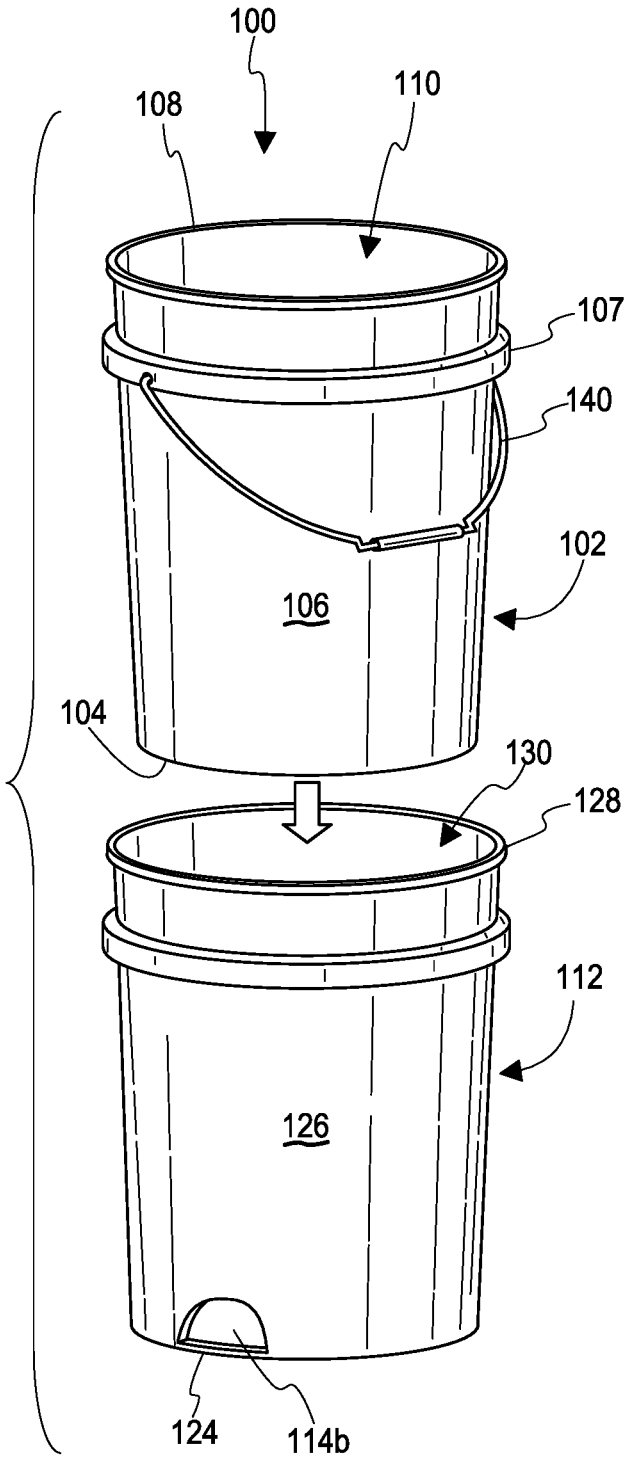
FIG. 1B is a side view of an exemplary second container receiving an exemplary first container, in accordance with an embodiment of the disclosure.
Figure 2:
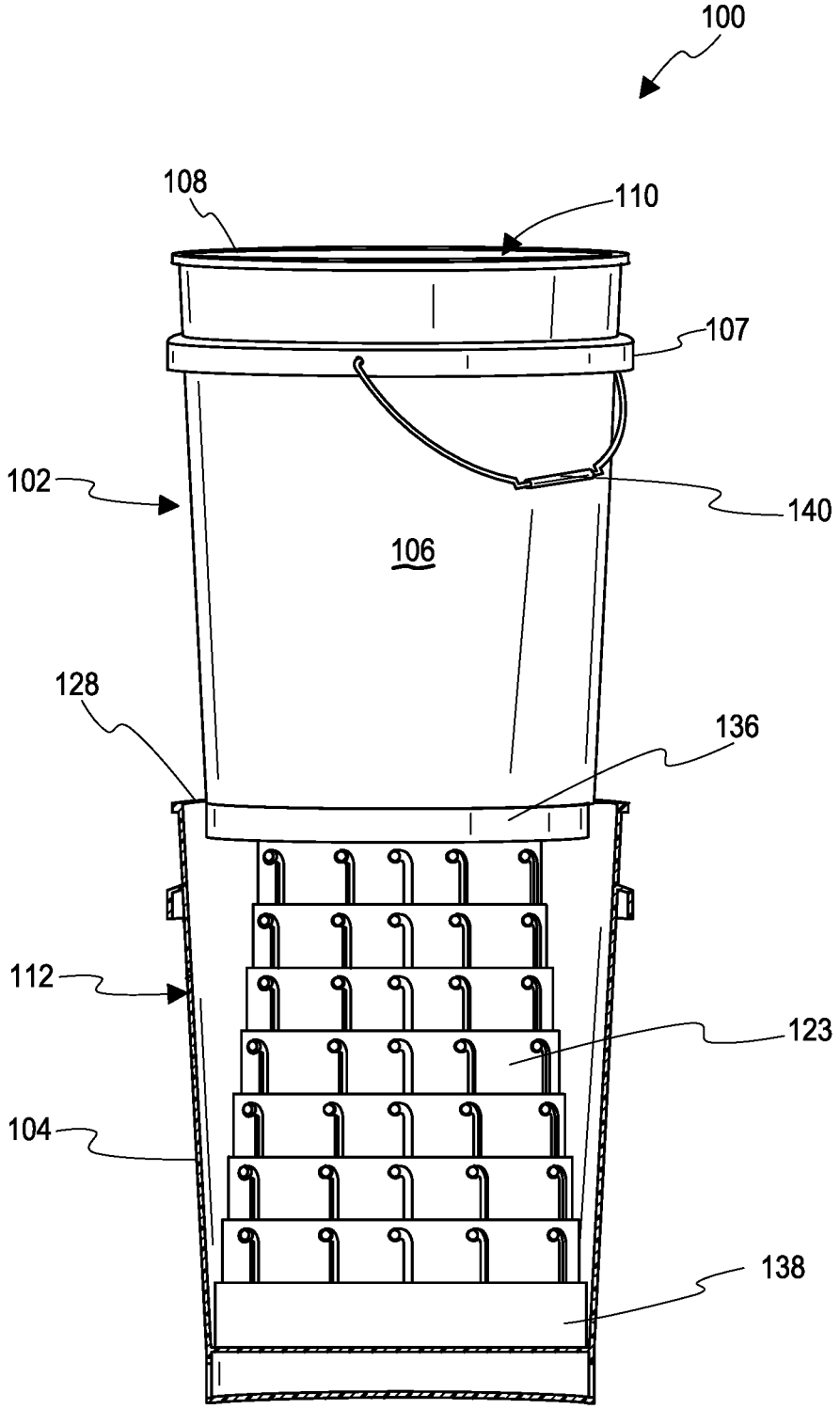
FIG. 2 is a side view of an exemplary sports ball easy loading and unloading apparatus showing an upper container and a sectioned view of the lower container with the ring components visible.

As illustrated in FIG. 1B, the apparatus 100 provides a first container 102 configured to contain sports balls 500*a-n*. The first container 102 is disposed inside a second container 112 having a larger diameter (See FIG. 3). The first container 102 can elevate and lower in relation to the second container 112. A elevator 118 is disposed inside the second container 112, and beneath the floor wall of the first container 102.

Figure 3:
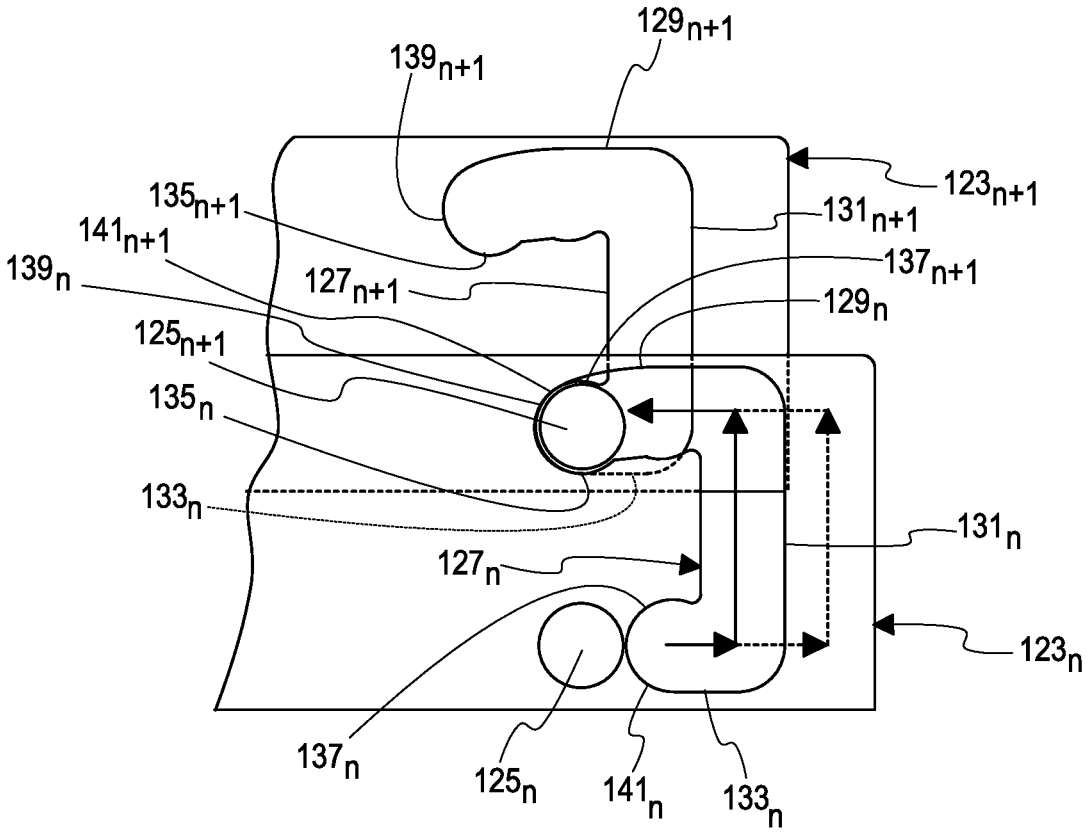
FIG. 3 is a sectioned view of the second container, showing the spring-loaded elevator fully expanded, in accordance with an embodiment of the disclosure.
Figure 4:
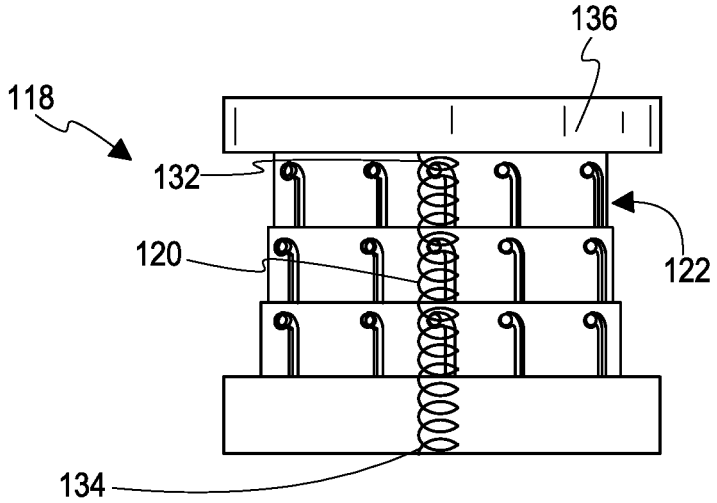
FIG. 4 is a side view of an exemplary spring-loaded elevator, in accordance with an embodiment of the disclosure.

The elevator 118 comprises a suitable biasing component, illustrated in FIGS. 3-4 as a helical coil spring 120 that biases to expand, and relatively rotatable turntables configured to lock the spring 120 at a desired position, such that the first container 102 can be locked at a desired position relative to the second container 112. In this manner, the elevator 118 enables selective elevation, lowering, and positional locking of the first container 102 for easy loading/unloading of balls 500*a-n*. A user can also sit on a lid 116 atop the first container 102 when fully compressed inside second container 112.

In one aspect, shown in FIGS. 5-10, the sports ball easy loading and unloading apparatus 100, comprises:

- a first container 102 defining a floor wall 104 and a sidewall 106, the sidewall 106 of the first container 102 terminating at a rim 108 defining an opening 110, the first container 102 having a first diameter, the first container 102 being sized and dimensioned to enable containment of one or more balls 500*a-n;*
- a lid 116 that selectively covers the opening in the first container 102;
- a second container 112 defining a floor wall 124 and a sidewall 126, the sidewall 126 of the second container 112 terminating at a rim 128 defining an opening 130, the second container 112 having a second diameter, the second diameter being larger than the first diameter, the second container 112 configured to contain the first container 102 such that the floor walls 104, 124 are in a parallel, spaced-apart relationship;
- a foot tab 114*a*, fixedly joined at or near the junction between the sidewall and the floor wall of the second container 112, the foot tab 114*a*, configured to enable a force or weight to at least partially anchor the second container 112 to a ground surface;
- a elevator 118 disposed between the floor walls of the first and second containers 102, 112, the elevator 118 comprising:
  - a spring 120, the spring 120 defining an upper end 132 oriented towards the floor wall 104 of the first container 102 and a lower end 134 oriented towards the floor wall 124 of the second container 112,
  - the spring 120 being biased to expand, whereby, when expanding, the spring 120 urges the first container 102 to elevate in relation to the second container 112,
  - the spring 120 further being compressible, whereby, when the spring 120 is fully compressed, the first container 102 is nested within and substantially contained inside the second container 112;
  - an upper turntable 136 engaging the upper end 132 of the spring 120; and
  - a lower turntable 138 engaging the lower end 134 of the spring 120,
  - at least one of the turntables 136, 138 being configured to rotate in a first direction to operate in a free position to ride the extension and contraction of the spring 120, at least one of the turntables 136, 138 being further configured to rotate in a second direction to achieve a locked position to restrict extension and/or contraction of the spring 120.

In another aspect, the first container 102 comprises a 6-gallon bucket.

In another aspect, the first container 102 comprises a 5-gallon bucket.

In another aspect, the second container 112 comprises a 6-gallon bucket.

In another aspect, the elevator 118 further comprises a spring housing 122, the spring housing 122 encapsulating the spring 120, the spring housing 122 being extendable and retractable in conjunction with the position of the spring 120.

In another aspect, with reference to FIGS. 3 and 3A, the spring housing 122 is a telescoping housing comprising a plurality of intereconnected, telescoping nested ring components 123$_n$, also collectively referred to as ring components 123, ordinal subscripts being omitted where ring components 123 and/or their features are described without relation to a neighboring nested ring component 123 or its features. Each telescoping ring component 123 includes a plurality of sideways horseshoe shaped arrangements of a connecting peg 125 and a connecting slot 127. The peg 125 projects radially outwardly beyond an otherwise generally uniform radial thickness of the ring component 123, by a distance equal to or slightly less than that generally uniform radial thickness, thus approximately doubling the radial thickness of the ring component 123 over an area comprised in the peg 125. The slot 127 comprises an opening extending through the entire generally uniform portion of the radial thickness of the ring component 123.

As best seen in FIG. 3A, the slot 127 movably retains a peg 125 of a next inner ring component 123, as described in more detail below. Each slot 127 includes an upper circumferential leg 129, a vertical leg 131, and a lower horizontal leg 133, the upper circumferential leg 129 comprising a retraction locking seat 135 and the lower horizontal leg 133 comprising an extension locking seat 137. The slot 127 has a first end 139 in the retraction locking seat 135 and a second end 141 in the extension locking seat 137. The slot 127 extends along the upper circumferential leg 129 in a circumferential unlocking direction from the first end 139 to the vertical leg 131, continues along the vertical leg 131 in a downward direction from the upper circumferential leg 129 to the lower horizontal leg 133, and continues along the lower horizontal leg 133 in a horizontal circumferential unlocking direction from the vertical leg 131 to the second end 141. In an embodiment (not shown), the upper circumferential leg 129 has an upward slope in the circumferential locking direction, thus serving to cam the peg $\mathbf{125}_{n+1}$ in the locking direction as the upper turntable 138 is raised, such as by expansion of the spring 120, a manual lifting force, or both in cooperation.

The horizontal legs $\mathbf{129}_n$, $\mathbf{133}_n$ have a vertical width generally accommodating a vertical span of the peg $\mathbf{125}_n$ with minimal or no clearance, and the vertical leg $\mathbf{131}_n$ has a horizontal width generally accommodating a horizontal span of the peg $\mathbf{125}_n$ with no or minimal clearance. The upper circumferential leg $\mathbf{129}_n$ guides circumferential retraction locking and unlocking movements of a retained peg $\mathbf{125}_{n+1}$, from the vertical leg $\mathbf{131}_n$ to the extension locking seat $\mathbf{135}_n$, a corresponding to rotation of a ring component $\mathbf{123}_{n+1}$ relative to a next outer ring component $\mathbf{123}_n$, as well as vertical extension and retraction movements of a retained peg $\mathbf{125}_{n+1}$ of a next inner ring component $\mathbf{123}_{n+1}$.

With reference to FIGS. 3 and 3A, the construction of the interconnected. Beginning with an outermost ring component 123 that is attached to the lower turntable 138 (though not separately illustrated, the outermost ring component 123 does not require a peg $\mathbf{125}_n$), each successive ring component $\mathbf{123}_{n+1}$ being extendably and retractably connected within a preceding ring component $\mathbf{123}_n$. The ring component $\mathbf{123}_{n+1}$ is similar in structure and comprises analogous features to those of the ring component $\mathbf{123}_n$, which are identified by corresponding reference numerals bearing the subscript $_{n+1}$. The lower horizontal legs 133 (where a reference numeral omitting the subscript n or $_{n+1}$ refers generically to the corresponding feature of all ring components 123) are shorter than the upper circumferential legs 129 of the corresponding slots 127. This allows the peg $\mathbf{125}_n$ to be disposed directly vertically below a subsequent peg $\mathbf{125}_{n+1}$ when the subsequent ring component $\mathbf{123}_{n+1}$ is in the extended position as shown in FIG. 3A, the peg $\mathbf{125}_{n+1}$ being seated in the retraction locking seat $\mathbf{135}_n$, with the peg 125*n* being spaced circumferentially beyond the second end 141*n* of the slot 127*n*. It is believed to be structurally beneficial for pegs 125 of successive ring components 123 in extended positions to be vertically aligned, so as to provide one or more straight vertical load paths through the spring housing 122, which is believed to provide improved stability and reduced sheer stresses compared to offset load paths. The lower horizontal leg 133 being shorter than the upper circumferential leg 129 of each slot 127 allows the pegs 125 to be positioned so as to provide such a straight vertical load path through vertically aligned pegs 125 without a particular peg 125*n* overlapping any portion of the corresponding slot 127*n*, This avoids the need for any reduction in the radial thickness of the ring component 123*n* behind the pegs 125*n*, thus beneficially avoiding undue stress concentrations when vertical loads are transferred from one ring component 123 to another through the pegs 125*n*.

In another aspect, the first container 102 comprises a handle attached to the rim.

In another aspect, the locked position of the turntables comprises the perimeter of the turntables engaging the sidewalls of the first and second containers 102, 112, whereby the spring 120 is restricted from expanding or compressing at the point where the turntables engage the sidewalls.

In another aspect, the locked position of the turntables comprises latching the perimeter of the turntables to an anchor, whereby the spring 120 is restricted from expanding or compressing at the point where the turntables latch to the anchor.

In another aspect, the apparatus 100 further comprises multiple fasteners configured to fasten the respective upper and lower turntables 136, 138 to the respective floor walls 104, 124 of the first and second containers 102, 112.

In another aspect, the containers are fabricated from plastic material.

Figure 5:
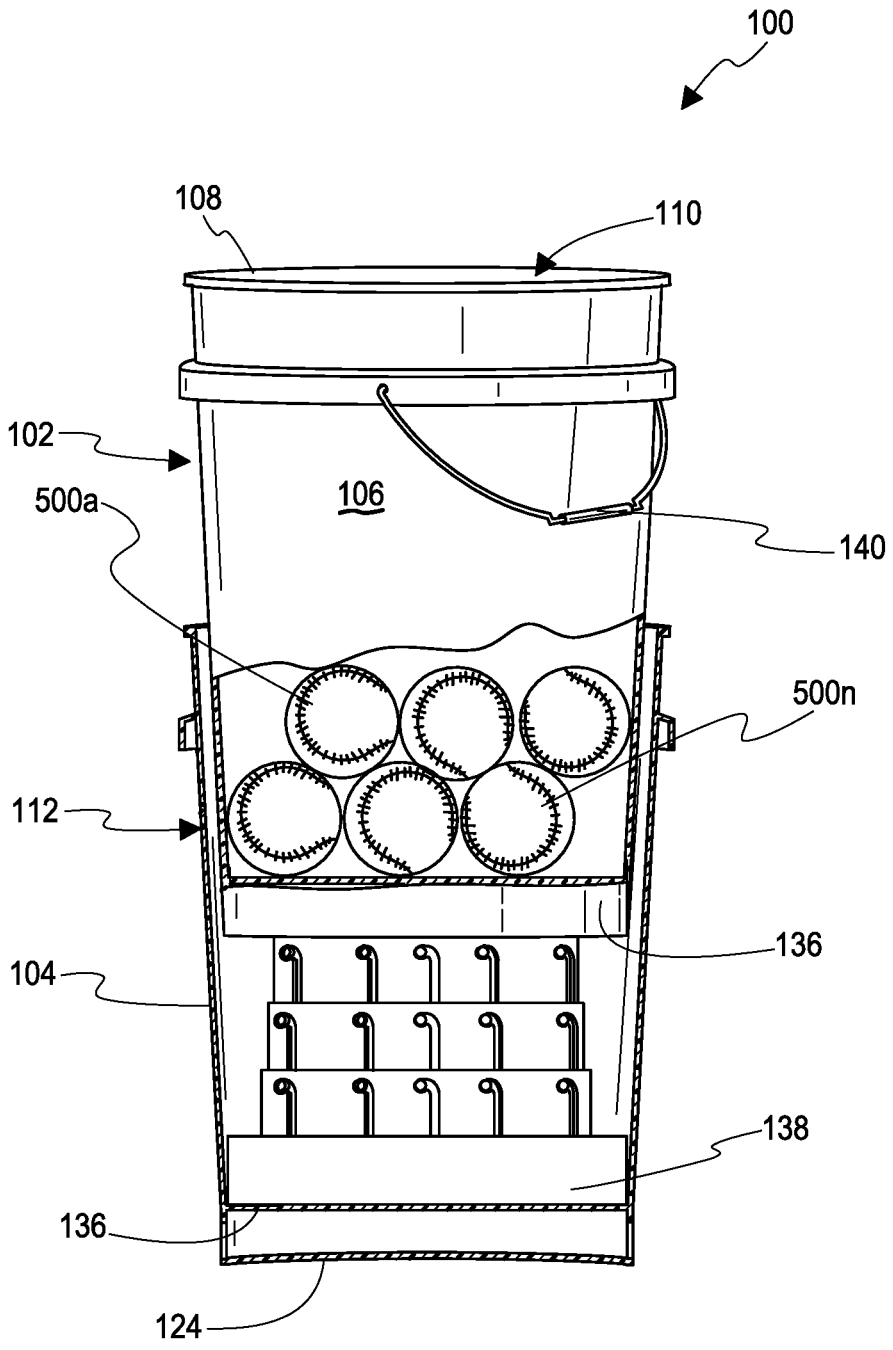
FIG. 5 is a sectioned view of the first container containing balls and compressed into the second container, in accordance with an embodiment of the disclosure.

Looking now at FIG. 5, the apparatus 100 comprises a first container 102 that serves as the primary vessel for containing one or more sports balls. Put another way, the first container 102 is sized and dimensioned to enable containment of one or more sports balls 500*a-n* (See FIG. 9). The sports balls 500*a-n* may include, without limitation, baseballs, softballs, golf balls, basketballs, soccer balls, cricket balls, and various pucks. While contained in the first container 102, the sports balls are conglomerated for easy access; whether for loading or unloading the balls from the first container 102.

In some embodiments, the first container 102 defines a floor wall 104 and a sidewall 106, forming a generally cylindrical shape. In one non-limiting embodiment, the first container 102 comprises a 5-gallon bucket. However, in other embodiments, the first container 102 can have a rectangular shape, a cubicle shape, triangular shape, and an irregular shape. In any case, the shape of the first container 102 must accommodate multiple sports balls 500*a-n*.

Looking again at FIG. 1A, the sidewall 106 of the first container 102 terminates at a rim 108 defining an opening 110. The first container 102 has a first diameter, the first diameter being an outer diameter of the first container 102, which in one embodiment is about 12". However, the disclosure is scalable such that different diameters, heights, and weight may be used. In some embodiments, portability of the apparatus 100 is enhanced due to a lightweight, plastic fabrication, and a handle 140 attached to the rim 108 of the first container 102.

In some embodiments, a lid 116 selectively covers the opening in the first container 102. The lid 116 can have substantially the same shape as the opening in the first container 102. The lid 116 serves to regulate access to the interior cavity of the first container 102, and also serves as a seat when the first container 102 is fully compacted into the second container 112, as discussed below.

A similarly shaped second container 112 works in conjunction with the first container 102. The second container 112 has a second diameter, the second diameter being an inner diameter of the second container 112, the second diameter being larger than the first diameter. In this manner, the second container 112 is sufficiently sized to at least partially receive the first container 102. The second container 112 defines a floor wall 124 and a sidewall 126, forming a generally cylindrical shape. In embodiments, the second container comprises a 6-gallon bucket. In more particular embodiments, including the illustrated embodiments, the first container 102 and the second container 112 each comprise a 6-gallon bucket, each having a substantially identical overall bucket shape, notwithstanding the presence of a foot tab 114*a* or foot cavity 114*b* that protrudes from or extends into a periphery of the second container 112. A portion of an inner peripheral surface of the bucket shape and a portion of an outer peripheral surface of the bucket shape have a substantially identical taper, so as to permit the first container 102 to nest within the second container 112. In such embodiments, the second diameter of the second container is located at a higher position on the bucket shape than the first diameter of the first container.

The sidewall 126 of the second container 112 terminates at a rim 128 defining an opening 130, which is sufficiently sized to receive the first container 102. Furthermore, the second container 112 is configured to contain the first container 102 such that the floor walls are in a parallel, spaced-apart relationship.

In some embodiments, a foot tab 114*a*, fixedly joins at or near the junction between the sidewall and the floor wall of the second container 112 (FIG. 1B). The foot tab 114*a*, is configured to enable a force or weight to at least partially anchor the second container 112 to a ground surface.

For example, a user can step on the foot tab 114*a*, while pulling up on the handle of the first container 102, or rotating the first container 102 in a first or second direction, such that a elevator 118 supporting the first container 102 is released or locked into place. During these manipulations, the foot tab 114*a*, prevents the entire apparatus 100 from moving unnecessarily, and thereby disturbing the expansion or compression of the elevator 118.

In other embodiments, a cavity 114*b* containing a pedal or other triggering mechanism can fulfill the same function as the foot tab 114*a*; i.e., to operate the elevator 118, and to prevent the apparatus 100 from moving unnecessarily.

Looking again at FIG. 4, the apparatus 100 provides a elevator 118, which is the primary mechanism that, when rotated in a first direction, enables the first container 102 to be elevated to the fully extended or a desired higher intermediate position, and thereby to make the sports balls contained therein generally more accessible to a standing user, as well as to be lowered to a fully contracted or a desired lower intermediate position. Conversely, when rotated in a second direction, the elevator 118 locksin a set position to fix the position of the first container 102 relative to the second container 112.

In an embodiment, the elevator 118 is disposed, and fixedly attached, between the floor walls of the first and second containers 102, 112. In some embodiments, the apparatus 100 provides multiple fasteners that are configured to fasten the turntables to the floor walls of the first and second containers 102, 112.

Suitable fasteners may include, without limitation: self-tapping screws, bolts, nails, magnets, snap-fit components, plastic welding, and adhesive material. This may include four self-tapping screws that fasten the upper turntable to the floor wall of the first container 102; and four self-tapping screws that fasten the lower turntable to the floor wall of the second container 112. This attachment allows elevator 118 to be rotated through rotation of the first container 102.

The components of the elevator 118 comprise a lift-assist spring 120, a spring housing 122, and upper and lower turntables. The spring 120 may include a simple coil spring 120 that defines an upper end oriented towards the floor wall of the first container 102, and a lower end oriented towards the floor wall of the second container 112. The spring 120 extends axially, or vertically, along the length of the apparatus 100. In other embodiments, a lift-assist spring is omitted, and an elevator is operative to freely contract under the weight of a first container, including its contents, if any, and to be expanded manually by a user lifting the first container, the first container being operatively connected to the elevator. In still other embodiments, an elevator includes a spring, but unlike the spring 120, which is biased to expand and thereby to provide a lift-assisting force, the spring is biased to compress and thereby to provide a force that assists with fully contracting/collapsing the apparatus.

The spring 120 is biased to expand, converting spring potential energy. Due to its position relative to the first container 102, when the spring 120 expands, this works to urge the first container 102 upwardly, or put another way, to elevate the first container 102 in relation to the second container 112. Additionally, the spring 120 is compressible when a force is applied thereon. Thus, when the spring 120 is fully compressed, the first container 102 is nested within and substantially contained inside the second container 112. The spring 120 can be compressed by a user applying weight pressing down on to the first container 102. The first container 102 comprises a stop flange 107 formed on an outer surface of its sidewall 106, stop flange 107 being in the form of an annular collar that circumscribes and extends radially outwardly from the sidewall 106. A bottom side of the collar 107 is adapted and configured to abut a top side of the rim 128 of the second container 112 when the first container 102 is inserted to a fully inserted position at which the collar 107 meets the rim 128, the abutting contact of the collar 107 with the rim 128 substantially preventing further insertion of the first container 102 into the second container 112. The "fully compressed" state of the spring 120 will be understood to be the state of the spring 120 corresponding to a state of the apparatus 100 in which the first container 102 is thus fully inserted into the second container 112.

In some embodiments, the elevator 118 also includes a spring housing 122 that encapsulates the spring 120. The spring housing 122 is a tapered plastic vessel that is configured to expand and retract, in conjunction with the position of the spring 120. Thus, as the spring 120 expands, the spring housing 122 also expands the same length. In one possible embodiment, shown in FIG. 3, the spring housing 122 is narrow towards the upper end of the spring 120, and wide towards the lower end of the spring 120.

To regulate the spring 120, the apparatus 100 provides an upper turntable 136 and an opposing lower turntable 138. The upper turntable 136 engages the upper end of the spring 120, which lies directly beneath the upper turntable 136. The lower turntable 138 engages the lower end of the spring 120, which lies directly above the lower turntable 138. In essence, the upper and lower turntables 136, 138 sandwich the spring 120, or spring housing 122, and move in axial correspondence with the spring 120.

The turntables 136, 138 are configured to rotate relative to each other in the unlocking direction, i.e., the upper turntable 136 rotating counterclockwise relative to the lower turntable 138, from a relatively locked position to a relatively free position.

When the turntables 136, 138 are in the relatively free position, the relative vertical movement of the turntables 136, 138 is not locked; that is, the turntables 136, 138 are free to be moved vertically toward each other, away from each other, or both, when acted upon, for example, by a lift-assisting/biasing force from the spring 120 or other suitable biasing element, by the weight of the first container 102 and/or its contents, and/or by an outside force such as the weight of a user on the first container 102 or a pushing or pulling force manually applied by a user to the first container 102, or a combination of such forces. As the upper turntable 136 is raised and/or lowered it, rides the expansion and compression of the spring 120.

Conversely, the turntables 136, 138 are configured to rotate relative to each other in a locking direction, i.e., the upper turntable 136 rotating clockwise relative to the lower turntable 138, from the relatively free position to the relatively locked position. The the relatively locked position restricts or limits vertical movement of the upper turntable 136 in one or both vertical directions relative to the lower turntable 138, thereby limiting the range over which the spring 120 is free to expand and/or to compress, compared to its freedom to expand and/or to compress in the relatively free position. Relative rotation of the turntables 136, 138 may relatively limit expansion and/or compression of the spring 120 by any of various suitable mechanisms corresponding to various embodiments.

For example, with reference to FIG. 3, supposing that the ring component $\mathbf{123}_{n+1}$ is the innermost ring component 123 of the spring housing 122, which is attached to the upper turntable 136, the ring component 123*n*+1 and its features, including the peg 125*n*+1, will rotate and move vertically in concert with the upper turntable 136. Accordingly, the path of the peg 125*n*+1 shown by the solid arrows in FIG. 3 reflects a counterclockwise, unlocking rotation of the upper turntable 136 (relative to the next outer ring component 125*n*) through an angular displacement corresponding to movement of the peg 125*n*+1 along the circumferential length of the lower leg 133*n* of the slot 127*n* of the next outer ring component 123*n*, to a relatively unlocked position, in which the peg 125*n*+1 is unseated from the extension locking seat 137*n* and moved into the vertical leg 131*n*. This frees the upper turntable to be raised by a vertical distance corresponding to that traveled by the peg 125*n*+1 in the vertical leg 131*n*, and the spring 120 to expand by a corresponding length, followed by a clockwise, locking rotation of the upper turntable 136 to seat the peg 125*n*+1 in the retraction locking seat 135*n* of the slot 127*n*, thus restraining the ring components 123*n*, 123*n*+1 from relatively retracting, as well as the upper turntable 136 from being directly lowered, or the spring 120 from being directly vertically compressed, back to the state in which the peg 125*n*+1 was initially seated in the extension locking seat 137*n*, without reversing the solid arrow path, starting with an unlocking counterclockwise relative rotation of the upper turntable 136, followed by a vertically downward movement, and then a locking clockwise relative rotation to seat the peg 125*n*+1 again in the extension locking seat 137*n*.

However, the relative movements of the turntable 136 just described correspond only to the locking, unlocking, and extension/retraction of a single pair of nested ring components 123 of the spring housing 122. If the peg 125*n* is locked in an extension locking seat 137*n*−1 of a next outer ring component 123*n*−1 (not shown), then a further counterclockwise rotation of the peg 125*n*+1, as in the path illustrated by the broken arrows/broken arrow segments in FIG. 3, pushing against the vertical leg 131*n* of the slot 127*n* so as to compel the ring component 123*n* to rotate counterclockwise relative to the next outer ring component, and thus the peg 125*n* to be unseated from the extension locking seat and moved into the vertical leg of the corresponding slot, will unlock the next pair of nested ring components 123, so as to further expand the range of vertical extension permitted to the spring housing 122, as well as the range of raising movement permitted to the upper turntable 136, and thus the range of expansion permitted to the spring 120. From the foregoing description, it will be understood that locking and unlocking movements may thus propagate through all or a subset of nested pairs of ring components 123 of the spring housing 122, by manually rotating the upper turntable until the desired number of pairs are locked or unlocked, with respect to extension or retraction.

In another embodiment, the extension locking seat 137 is omitted from the slots 127, such that the elevator 118 comprises only a retraction locking mechanism, while the spring 120 is free to expand at all times, though it may be opposed from expanding by external forces, such as the weight of a user sitting on the second container 112 and/or the weight of the second container 112 itself, including that of sports balls or other contents, as well as being limited to the fully extended position of the spring housing 122, in which the pegs 125 of each nestepd pair of ring components 123 "top out" at the upper ends 139 of the corresponding slots 127.

In another embodiment, not shown, the spring loaded elevator 118 utilizes a locking mechanism that causes the perimeter of the turntable 136 to frictionally engage the sidewall 126 of the second container 112. This frictional engagement thus restricts the spring 120 from expanding or contracting, because the spring 120 cannot expand or contract without raising or lowering the turntable 136, to which the upper end of the spring 120 is attached. In embodiments, relatively rotating the turntables 136, 138 to the locked position may cause a periphery of the turntable 136 to expand uniformly so as to contact the sidewall 126. In other embodiments, such relative rotation of the turntables 136, 138 may cause one or more frictional holding members to extend radially outwardly from the peripheray of the turntable 136 so that the frictional holding members contact the sidewall 126. In either case, the expansion/radial outward extension may be driven by a camming mechanism (not shown).

In a second embodiment, a locking mechanism of the spring loaded elevator 118 comprises latching the perimeter of the upper turntable 136 to an anchor (not shown), whereby the spring 120 is restricted from expanding or compressing away from the point where the upper turntable 136 latches to the anchor (not shown).

The elevator 118 can utilize other locking mechanisms to restrict axial movement of the spring 120 to a desired position, relative to the first container 102. Such a locking mechanism could include bars that extend and retract between the coils of the spring 120. Another possible mechanism could be sidewalls the press about the entire outer surface of the spring 120 to prevent motion thereof. In yet other embodiments, any simple mechanism that can be fitted inside the second container 112 and selectively restrict expansion and compression of the spring 120 may be used.

In operation, a user initially carries the apparatus 100 from the handle of the first container 102 to the desired area for collecting, loading, unloading, or sorting the sports balls. This may include a sport playing field. The first container 102 is initially inside the second container 112, such that the spring 120 is fully compressed and the elevator 118 is in the locked position. The user places the second container 112 on the ground surface and begins tossing or placing the sports balls 500*a-n* into the first container 102.

Figure 6:
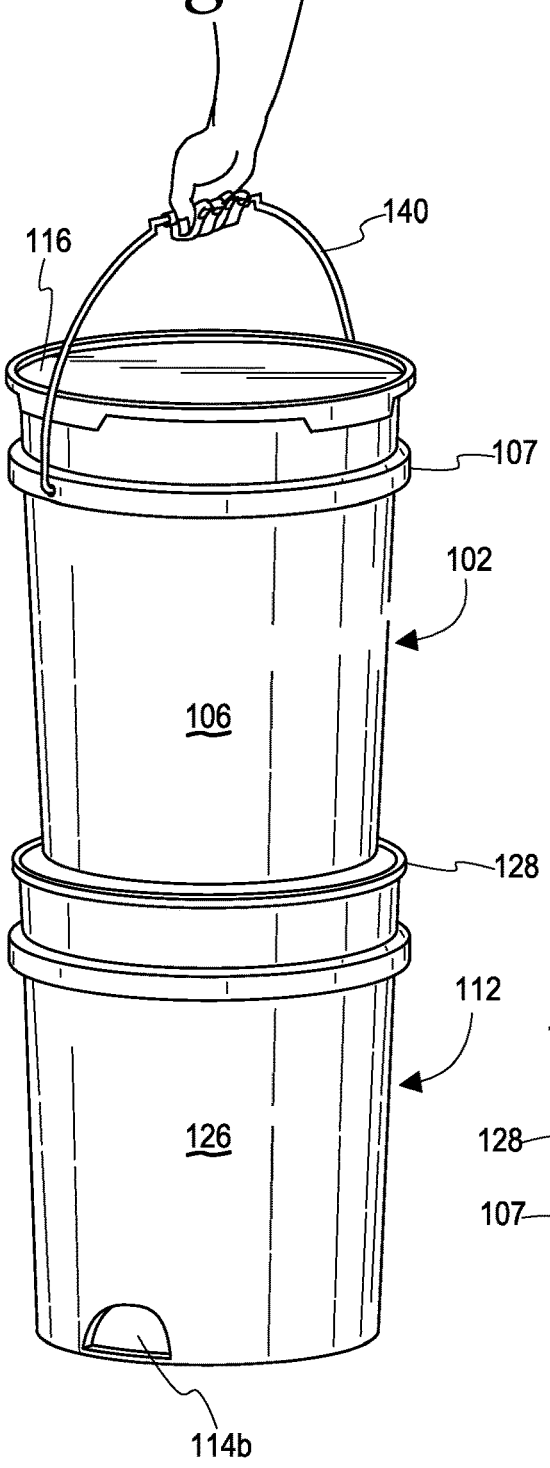
FIG. 6 is a perspective view of the first container being pulled by a user to expand relative to the second container, in accordance with an embodiment of the disclosure.
Figure 7:
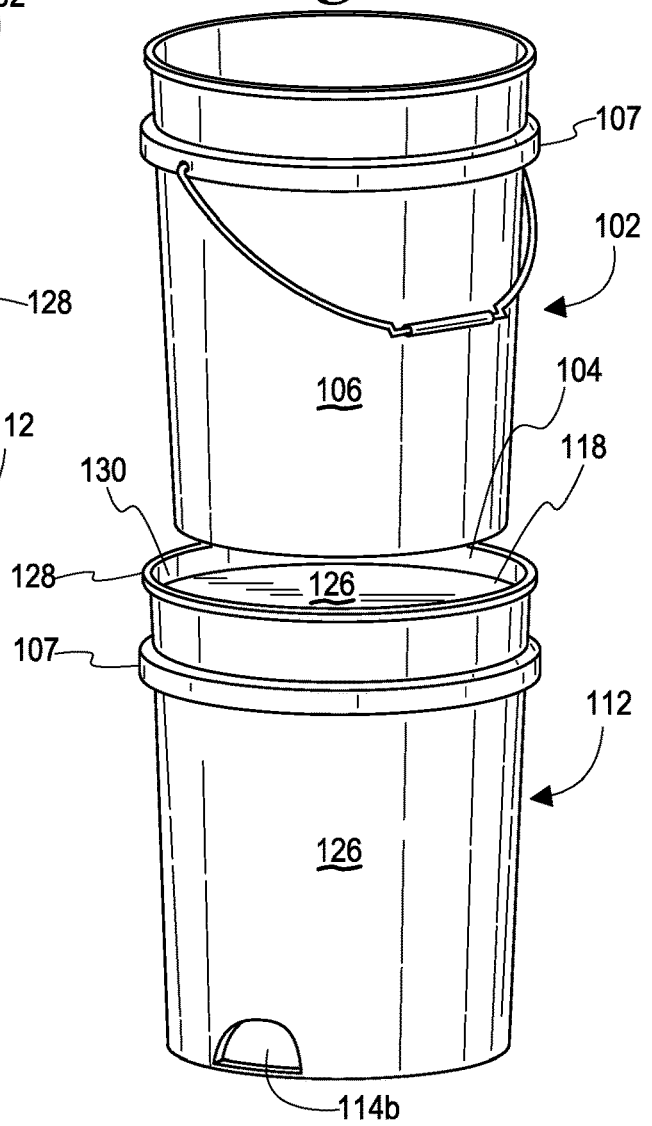
FIG. 7 is a perspective view of the spring-loaded elevator disposed between the first and second containers, in accordance with an embodiment of the disclosure.

After the first container 102 is sufficiently filled, the user carries the apparatus 100 to another location. The user then steps on the foot tab 114*a*, and rotates the first container 102 in the first direction so that the elevator 118 is in the free position, as shown in FIG. 7. The first container 102 is urged to elevate by the spring tension inherently generated from the spring 120. For example, FIG. 6 is a perspective view of the first container 102 being pulled by a user to expand relative to the second container 112.

Figure 8:
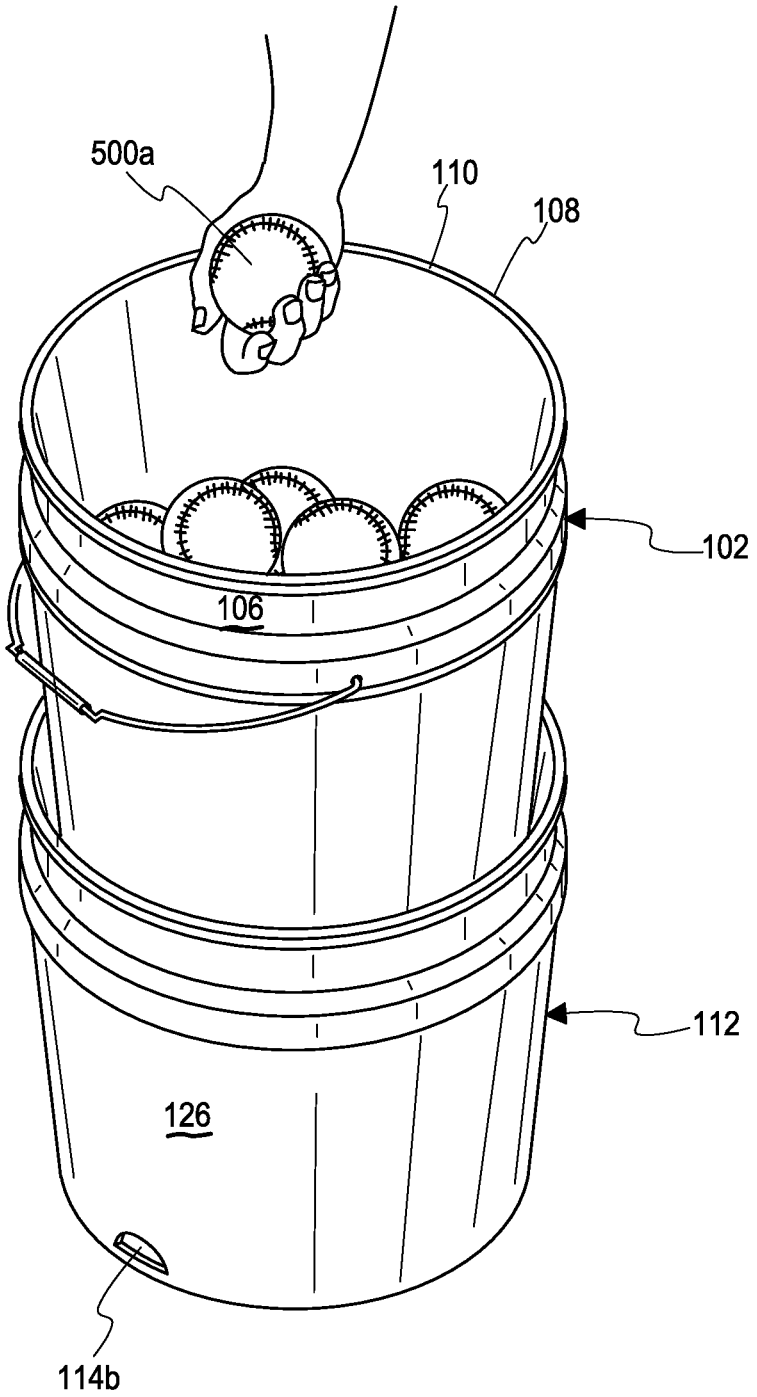
FIG. 8 is a perspective view of the user loading or unloading balls from the expanded first container, without requiring to be stooped over, in accordance with an embodiment of the disclosure.
Figure 9:
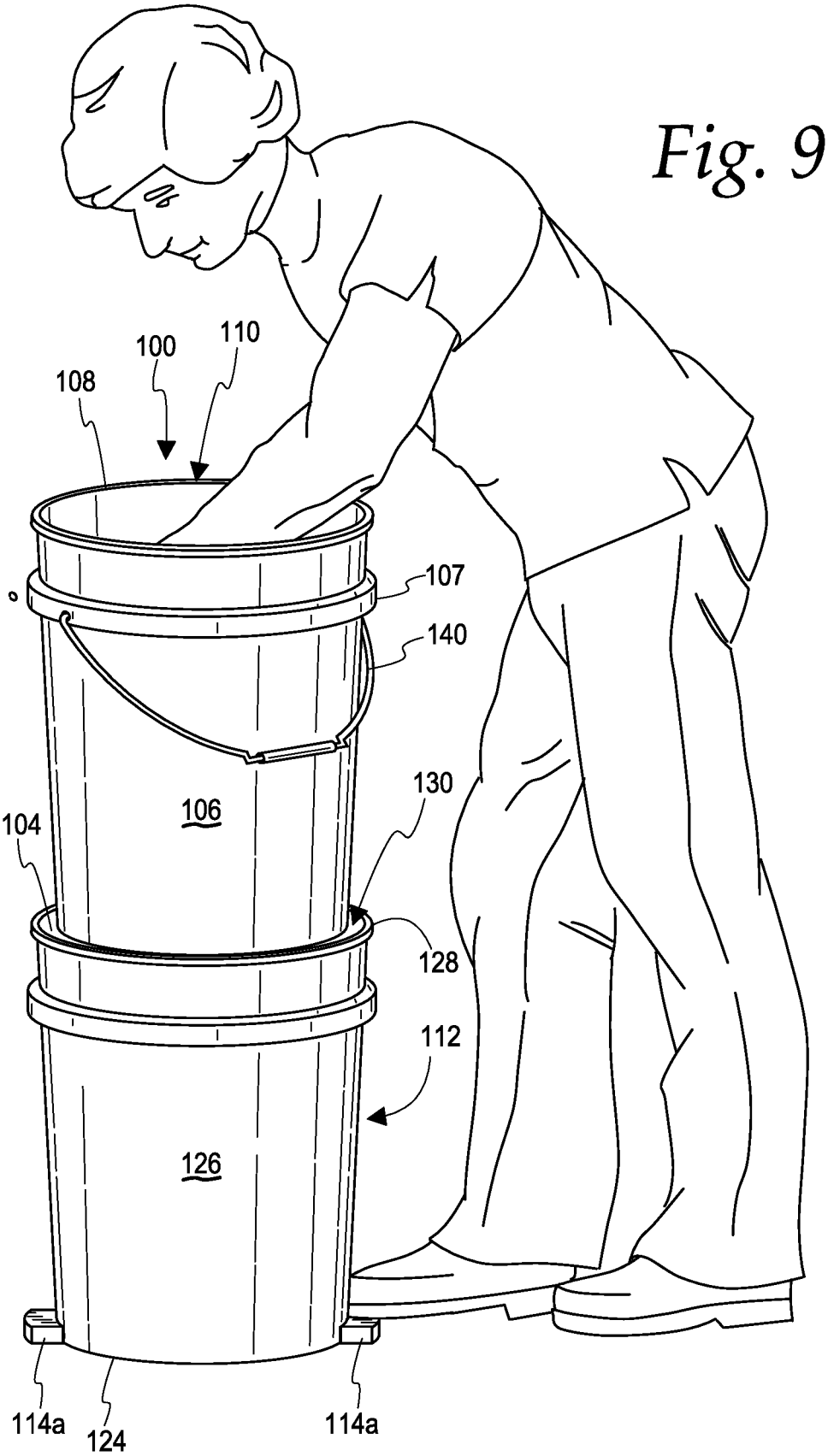
FIG. 9 is a perspective view of the user pressing down on the first container to compress into the second container, in accordance with an embodiment of the disclosure.

As FIG. 9 shows, the user may then begin grabbing the balls from the elevated position with less stooping and bending over then would have been necessary if the first container 102 were on the ground surface, for example. Also, as FIG. 8 shows, the user may drop balls 500*a-n* into the first container 102 when in the elevated disposition.

Figure 10:
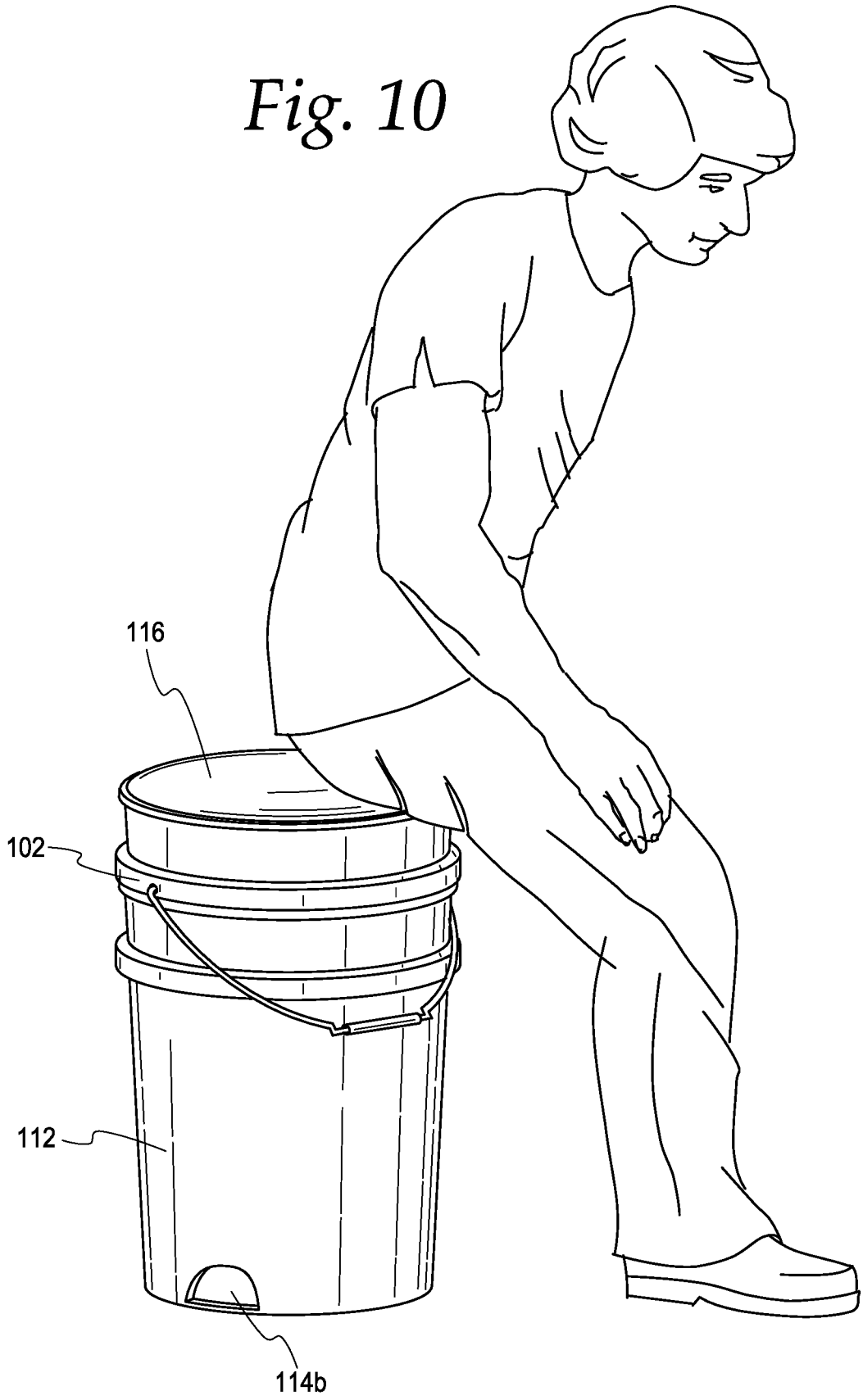
FIG. 10 is a perspective view of the user sitting on the lid covering the first container, which is fully compressed inside the second container, in accordance with an embodiment of the disclosure.
Figure 11:
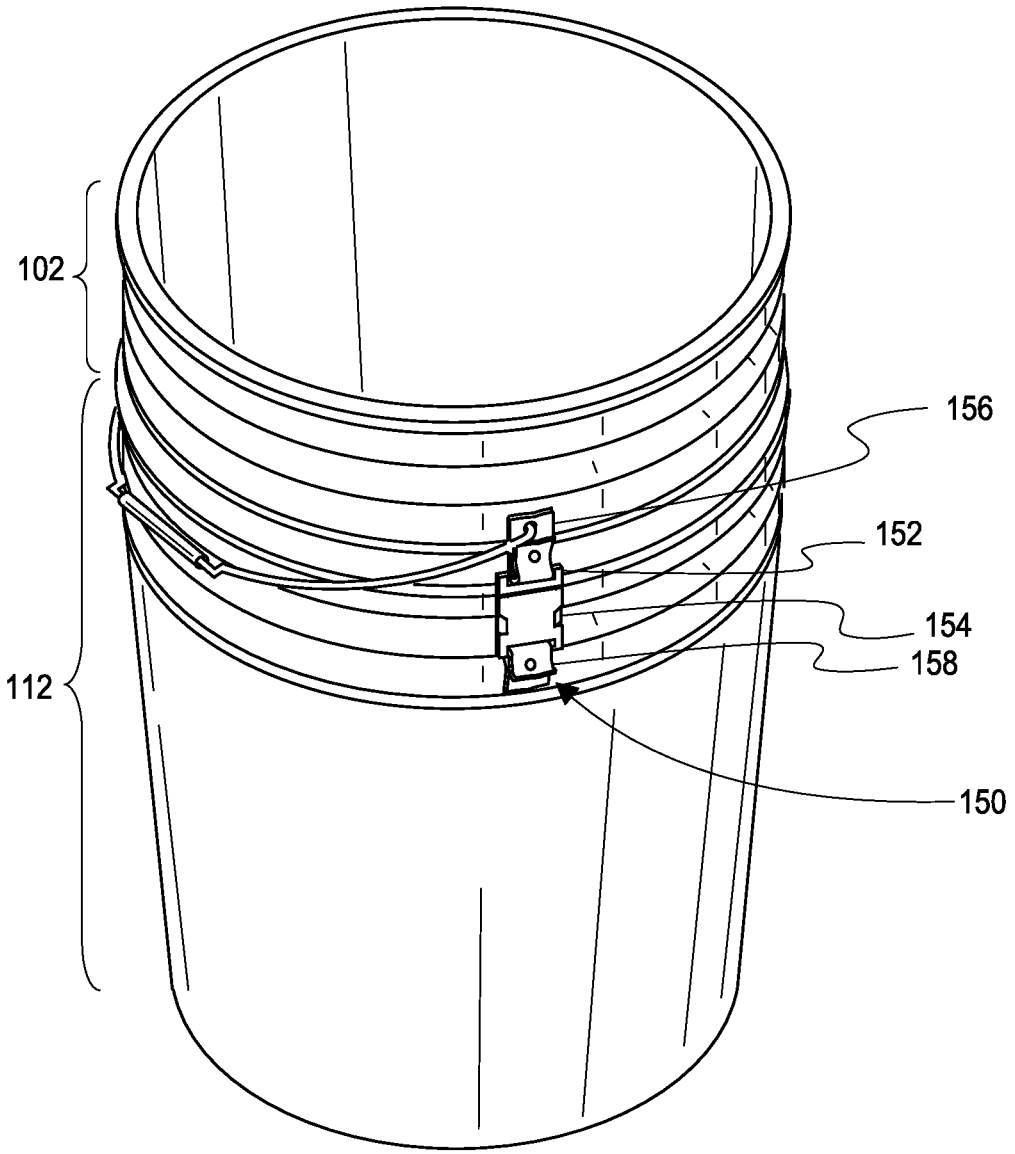
FIG. 11 is a perspective view of a sports ball loading and unloading apparatus comprising a strap retention system in accordance with an embodiment of the disclosure.

As illustrated in FIG. 10, the user may press down on the first container 102 to fully compress the spring 120; and thereby return the first container 102 inside the second container 112. Once fully compressed in this manner, the user can then rotate the first container 102 in the second direction so that the elevator 118 is in the locked position—at the compressed disposition. The user can then apply the lid 116 onto the opening of the first container 102, and sit on the lid 116 (See FIG. 11).

With reference to FIG. 12, an embodiment of the apparatus 100 is shown to include an optional strap retention system 150. The strap retention system 150 includes a male connector 152 associated with the first container 102 and a female connector 154 associated with the second container 112. The male connector 152 and the female connector 154 comprise a side-release buckle of a common type, which is connected by inserting the male connector 152 into the female connector 154 and released by squeezing the opposite sides of the inserted portion of the male connector 152 inwardly. The male connector 152 is attached to an upper strap 156, the upper strap 156 in turn being attached to the first container 102, while the female connector 154 is similarly attached to a lower strap 158, the lower strap 158 in turn being attached to the second container 112. Though not shown, the strap retention system 150 may further include a male connector 152, female connector 154, upper strap 156, and lower strap 158 similarly arranged at an opposite side of the apparatus 100.

When the male and female connectors 152 and 154 are connected, each of the upper and lower straps 156, 158 is stretched taut between the respective connector 152, 154 and the respective container 102, 112, such that the straps 156, 158 cooperate to tether the first container 102 in a fully inserted position within the second container 112. That is, tension in the straps 156, 158, when they are connected in this manner, operates to resist upward movement, and, albeit to a lesser degree, rotation, of the first container 102 relative to the second container 112.

The strap retention system 150 cooperates with the locking mechanism of the elevator 118 in at least two different ways. First, by resisting such relative upward movement of the first container 102, the strap retention system 150 supplements and/or serves as a backup to the locking mechanism of the elevator 118. Second, by resisting such relative rotation of the first container 102, the strap retention system 150 can operate to hold the turntables 136, 138 in their relative locked position, thus resisting disengagement of the locking mechanism of the elevator 118. Accordingly, in embodiments in which each of the upper and lower turntables 136, 138 is fixedly attached to the respective floor wall 104, 124 of the respective first or second container 102, 112, the turntables 136, 138 are preferably fixed in such positions relative to the respective first and second containers 102, 112 so that rotating the first container 102 to align the upper strap 156 directly above the lower strap 158 also relatively rotates the turntables 136, 138 to their relative locked position, so as to lock the locking mechanism of the elevator 118.

The preceding description of the disclosure has been presented for purposes of illustration and description and is not intended to be exhaustive or to limit the disclosure to the precise form disclosed. The description was selected to best explain the principles of the present teachings and practical application of these principles to enable others skilled in the art to best utilize the disclosure in various embodiments and various modifications as are suited to the particular use contemplated. It should be recognized that the words "a" or "an" are intended to include both the singular and the plural. Conversely, any reference to plural elements shall, where appropriate, include the singular.

It is intended that the scope of the disclosure not be limited by the specification, but be defined by the claims set forth below. For example, various embodiments have been presented that require the use of a spring with the disclosed elevator; however, those skilled in the art will recognize that no spring is required to make the elevator function; rather, the spring is facilitate ease-of-use. In addition, although narrow claims may be presented below, it should be recognized that the scope of this disclosure is much broader than presented by the claim(s). It is intended that broader claims will be submitted in one or more applications that claim the benefit of priority from this application. Insofar as the description above and the accompanying drawings disclose additional subject matter that is not within the scope of the claim or claims below, the additional disclosures are not dedicated to the public and the right to file one or more applications to claim such additional disclosures is reserved.

What is claimed is:

1. A sports ball easy loading and unloading apparatus, the apparatus comprising:

a first container defining a floor wall and a sidewall, the sidewall of the first container being fixedly connected to a perimeter of the floor wall of the first container and extending peripherally around and upwardly from said floor wall, the sidewall of the first container terminating at a rim defining an opening, the first container having a first diameter, the first container being sized and dimensioned to enable containment of one or more balls;

a second container defining a floor wall and a sidewall, the sidewall of the second container terminating at a rim defining an opening, the second container having a second diameter, the second diameter being larger than the first diameter, the second container configured to contain the first container such that the floor walls are in a parallel, spaced-apart relationship;

a vertically extendable and retractable elevator disposed within the second container below the floor wall of the first container and above the floor wall of the second container, the elevator comprising an upper turntable and a lower turntable, the upper turntable being movably connected to the lower turntable to permit the upper turntable to be movable upwardly to a raised elevation relative to the lower turntable to extend the elevator and, when at the raised elevation, to be rotatable relative to the lower turntable to a retraction locking position, the upper turntable in the retraction locking position being restrained from moving downwardly relative to the lower turntable, the upper turntable being fixedly attached to the first container and the lower turntable being fixedly attached to the second container.

2. The sports ball easy loading and unloading apparatus of claim 1 wherein the first container further includes a stop flange disposed beneath the rim of the first container.

3. The sports ball easy loading and unloading apparatus of claim 2 wherein the first container further includes a handle connected to a first point and a second point of the first container sidewall above the stop flange, wherein the first point is spaced apart from the first point along a perimeter of the sidewall, so that the handle is operative, when lifted and rotated, to move the first container upwardly so as to move the upper turntable upwardly to the raised elevation relative to the lower turntable and to rotate the first container so as to rotate the upper turntable at the raised elevation to the retraction locking position.

4. The sports ball easy loading and unloading apparatus of claim 1 wherein the elevator further comprises a plurality of vertically stacked rotatable ring components the ring components comprising a bottom ring component that is comprised in the lower turntable and a top ring component that is comprised in the upper turntable.

5. The sports ball easy loading and unloading apparatus of claim 4 wherein the elevator further comprises a helical coil spring that provides bias on the elevator.

6. The sports ball easy loading and unloading apparatus of claim 1 wherein the first container is five gallon bucket.

7. The sports ball easy loading and unloading apparatus of claim 1 wherein the second container is a six gallon bucket.

* * * * *